US008901904B2

(12) United States Patent
Caldwell

(10) Patent No.: US 8,901,904 B2
(45) Date of Patent: Dec. 2, 2014

(54) VOLTAGE AND CURRENT REGULATORS WITH SWITCHED OUTPUT CAPACITORS FOR MULTIPLE REGULATION STATES

(75) Inventor: Joshua William Caldwell, San Jose, CA (US)

(73) Assignee: Linear Technology Corporation, Milpitas, CA (US)

( * ) Notice: Subject to any disclaimer, the term of this patent is extended or adjusted under 35 U.S.C. 154(b) by 913 days.

(21) Appl. No.: 12/508,670

(22) Filed: Jul. 24, 2009

(65) Prior Publication Data

US 2010/0264890 A1 Oct. 21, 2010

Related U.S. Application Data

(60) Provisional application No. 61/169,421, filed on Apr. 15, 2009.

(51) Int. Cl.
*G05F 1/56* (2006.01)

(52) U.S. Cl.
CPC ..... *G05F 1/56* (2013.01)
USPC ..... 323/282; 323/285; 323/286

(58) Field of Classification Search
USPC ..... 323/224, 265–267, 271–272, 275, 323/280–286, 312–315, 351
See application file for complete search history.

(56) References Cited

U.S. PATENT DOCUMENTS 4,972,101 A * 11/1990 Partovi et al. ..... 326/86
5,336,985 A * 8/1994 McKenzie ..... 323/266
6,177,785 B1 1/2001 Lee
6,518,859 B1 * 2/2003 Spampinato ..... 333/174
6,879,194 B1 * 4/2005 Caldwell ..... 327/143
6,975,494 B2 * 12/2005 Tang et al. ..... 361/64
6,977,491 B1 * 12/2005 Caldwell et al. ..... 323/282
7,170,352 B1 * 1/2007 Caldwell ..... 330/261
2001/0004227 A1 * 6/2001 Frech et al. ..... 333/181
2004/0007918 A1 * 1/2004 Clevenger et al. ..... 307/126
2005/0122243 A1 * 6/2005 Miyagi ..... 341/141
2005/0206642 A1 9/2005 Kushima
2008/0001657 A1 * 1/2008 Zhang ..... 327/552
2008/0012654 A1 * 1/2008 Han et al. ..... 331/167
2008/0055018 A1 * 3/2008 Umamichi et al. ..... 333/181
2008/0081583 A1 * 4/2008 Zhang et al. ..... 455/193.1
2008/0144252 A1 * 6/2008 Abadeer et al. ..... 361/277
2008/0252146 A1 10/2008 Lin
2010/0244793 A1 * 9/2010 Caldwell ..... 323/282

FOREIGN PATENT DOCUMENTS

EP 1089154 A1 4/2001

* cited by examiner

*Primary Examiner* — Adolf Berhane
*Assistant Examiner* — Nusrat Quddus
(74) *Attorney, Agent, or Firm* — McDermott Will & Emery LLP

(57) ABSTRACT

A device and method of providing any one of a plurality of desired levels of a regulated signal output to a load is described, wherein each desired level is a function of a corresponding reference signal. The device is configured and the method is designed to (1) store each desired level of the regulated signal output on a switchable storage device; and (2) selectively switch the correct storage device to the output when switching from one regulated state to another so as to establish the desired level of regulated signal output.

14 Claims, 5 Drawing Sheets

VOLTAGE AND CURRENT REGULATORS WITH SWITCHED OUTPUT CAPACITORS FOR MULTIPLE REGULATION STATES

RELATED APPLICATION

This application is based upon and claims priority to U.S. Provisional Application Ser. No. 61/169,421, filed Apr. 15, 2009, the entire content of which is incorporated herein by reference.

FIELD OF THE DISCLOSURE

The disclosure relates generally to voltage and current regulators, and more specifically to regulators using switchable output capacitors for improving the output voltage response time of regulators when switching from one regulation state to another.

BACKGROUND OF THE DISCLOSURE

In prior art applications, such as generally shown in FIG. 1, the typical current or voltage regulator 10 includes regulator control circuit 12 and a control loop or feedback network 14 for regulating the output 22 provided to the load 16. The voltage output of the regulator 10 is usually set by a reference signal (current or voltage) $S_{REF}$ indicated at 18, while the output of the regulator 10 is typically bypassed with a single large capacitor 20. When the desired output voltage $V_{OUT}$ is required to change by a significant amount, the large output capacitor 20 must be charged or discharged to achieve the new regulation voltage $V_{OUT}$. This causes the transition time between regulated states to be excessively long and impractical for applications where the transition times must be less than several micro seconds. The large output capacitor 20 thus directly limits the step-response of the regulator's control loop.

More specifically, in order to change the regulation state of the regulator, the reference signal $S_{REF}$ is changed at the input 18. When the reference signal $S_{REF}$ is changed, the slew-rate of the output $V_{out}$ at 22 is limited to the current sinking or sourcing capabilities of the regulator 12, the impedance of the load 16, the size of the output capacitor 20, and the bandwidth of the regulator's control loop 14. For a stable control loop, the rise-time or decay time of the output may be limited from tens to hundreds of microseconds. This may be acceptable for systems where a single regulation state is desired, but can be unacceptable where the regulator is designed to operate in any one of a plurality of regulation states. It is desirable to provide a solution to allow a very fast response time to change from one regulation state to another without redesigning the control-loop, changing the bandwidth of the control-loop, or reducing the size of the output capacitor.

GENERAL DESCRIPTION OF THE DRAWINGS

In the drawings, like numerals are used to designate like parts. Referring to the drawings.

Figure 1:
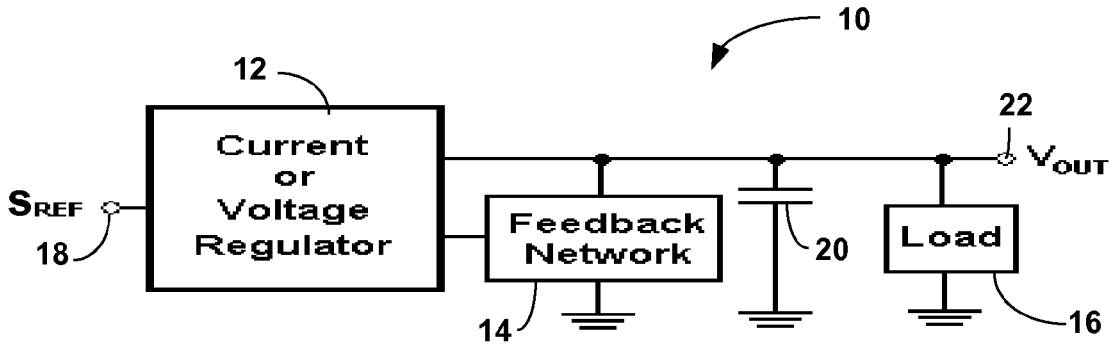
PRIOR ART FIG. 1
FIG. 1 is a generalized partial block and partial schematic diagram of a typical current or voltage regulator including a single bypass capacitor.
Figure 8:
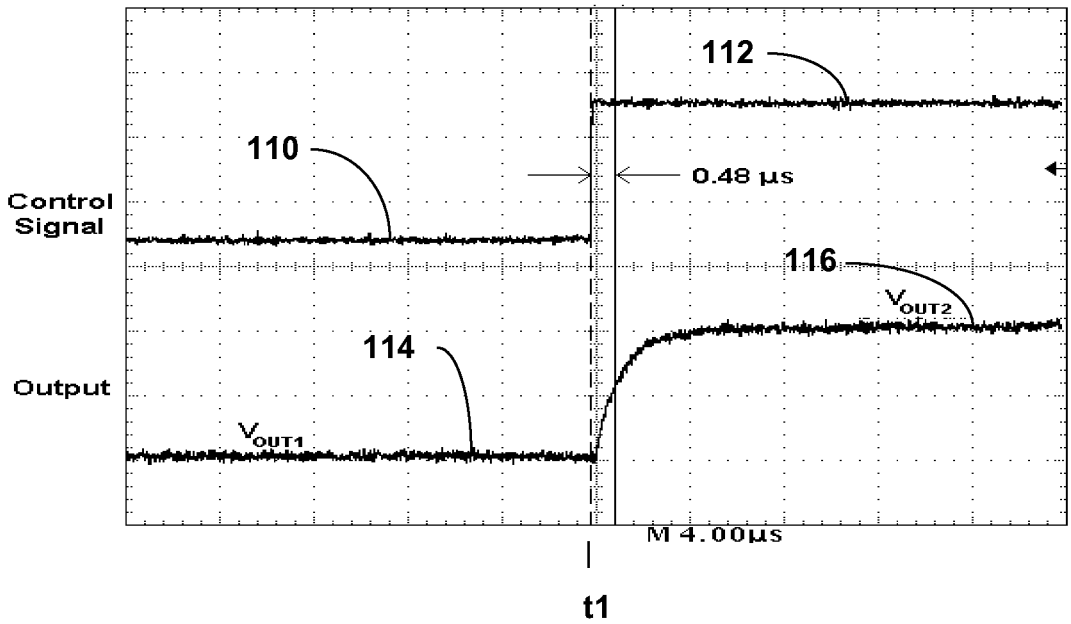
Figure 9:
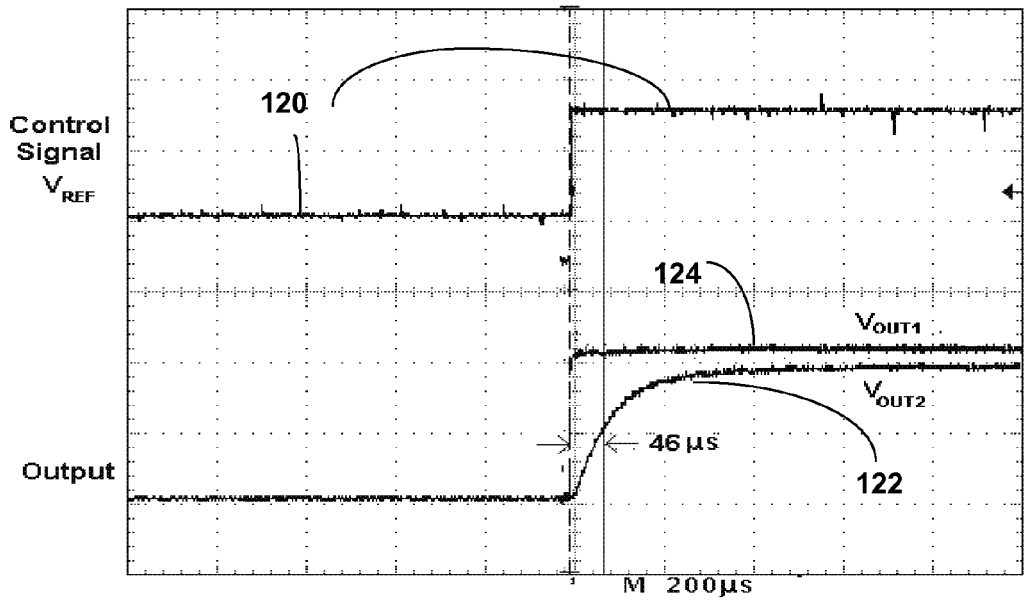

FIG. 8 is a graphical illustration of an exemplary response of a current or voltage regulator of the type shown in any one of the FIGS. 2-6 showing the rise time of the voltage output in response to a step in the reference voltage; and FIG. 9 is a graphical illustration of a comparison between the exemplary responses of a current or voltage regulator of the type shown in FIG. 1 and of any one of types shown in FIG. 2-6 showing the rise time of voltage output in response to a step in the reference voltage.

DETAILED DESCRIPTION OF THE DISCLOSURE

The following describes a system for and method of improving the response time of the output of a regulator when switching from one regulated state to another. Regulators which include control-loops have a finite bandwidth when responding to changes in regulated states. The system and method described herein has the effect of increasing the bandwidth without affecting the stability of the system or the output ripple at the output of the regulator where the load is connected.

In one embodiment the system includes a plurality of output bypass capacitors that are each charged to a voltage corresponding to the desired voltage output for a corresponding one of the desired regulated states. The capacitors are controlled so that they can be individually switched to bypass the output so as to immediately bring the voltage of the output to the desired level corresponding to its new regulation state. By switching each of the load capacitors, the voltage and current in the load may be changed as rapidly as the switches change states. Since the output capacitors are each very large, each of the capacitors provide the energy to the load until the regulator's control loop takes over and provides energy to the load while at the same time refreshing the capacitor providing the initial output voltage. At least two capacitors, corresponding to at least two regulated states, are required, although there is no limitation on the number of output capacitors or states that may be regulated. By switching the appropriate output capacitor, transition times between two regulated states can be reduced two orders of magnitude to several microseconds.

Figure 2:
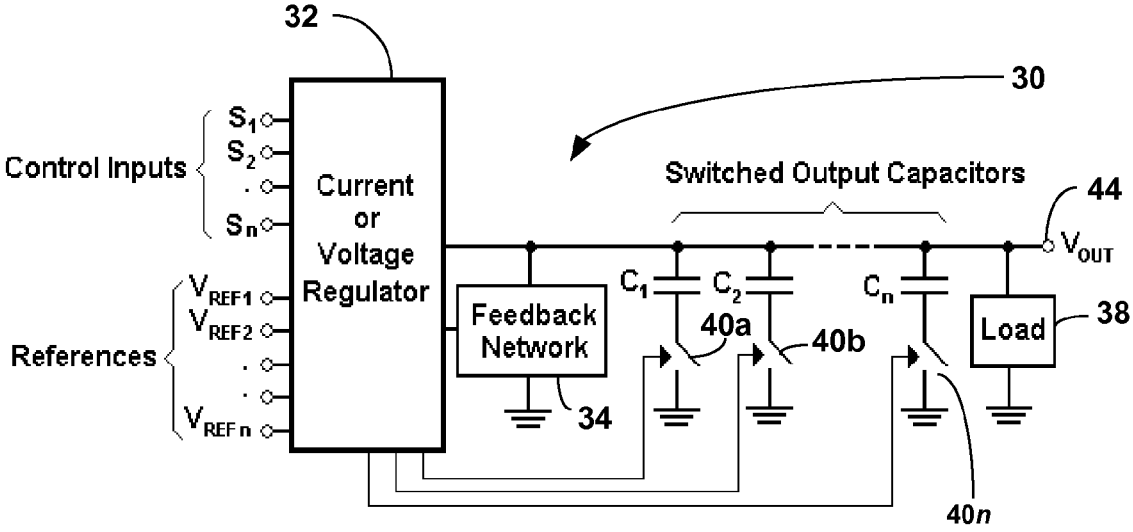
FIG. 2 is a generalized partial block and partial schematic diagram of one embodiment of a current or voltage regulator employing a plurality of bypass capacitors for use in operating in any one of a plurality of regulation states.

FIG. 2 illustrates one embodiment of a regulator 30 comprising a regulator control circuit 32, feedback network 34, and a plurality of switchable output bypass capacitors $C_1$, $C_2$ . . . $C_n$. The capacitors are connected in parallel with each other and with load 38. Each capacitor is also connected to system ground through a respective switch 40*a*, 40*b* . . . 40*n*. In addition to any other inputs (not shown) required to operate regulator 30, the regulator also includes a plurality of inputs constructed to receive signal inputs respectively representing a plurality of reference voltages (in the case of a voltage regulator) $V_{REF1}$, $V_{REF2}$ . . . $V_{REFn}$. A plurality of inputs are also provided for receiving control inputs $S_1$, $S_2$ . . . $S_n$ for respectively controlling the switches 40. In this embodiment the voltage across capacitor $C_1$ is determined by the reference voltage $V_{REF1}$, the voltage across capacitor $C_2$ is determined by the reference voltage $V_{REF2}$, and so on for all the reference voltages and capacitors. The individual switches 40 are controlled by the control inputs, with control input $S_1$ controlling switch 40*a* , control input $S_2$ controlling switch 40*b*, and so on for all of the control inputs and switches.

In operation, each of the capacitors of the embodiment of FIG. 2 is precharged to provide a desired voltage $V_{OUT}$ at the output 44 to be applied to the load 38 by closing the corresponding switch and applying the appropriate signals at the inputs S and $V_{REF}$. Once each capacitor C is precharged, the corresponding switch 40 is opened and the charge remains stored on the capacitor.

Once all of the capacitors are charged, the regulated state is controlled by the control inputs to the regulator. The voltage across $C_1$ is determined by the voltage at $V_{REF1}$, the voltage across $C_2$ is determined by the voltage at $V_{REF2}$, and so on forth for all references and output capacitors. The application of a control input S determines the regulation state, and in particular the reference voltage $V_{REF}$ to be used. Accordingly, in this embodiment the corresponding output capacitor C is switched onto the output terminal 44, with the remaining switches remaining open so as to provide the correct $V_{OUT}$ for the selected regulation state. With each capacitor being sized so as to be capable of being charged to a predetermined voltage as a function of the desired level of the regulated signal output, controlling the switches allows for selectively connecting at least one of the capacitors to the load depending on and as a function of the desired level of the regulated signal output so that when the reference signal is changed, at least one select capacitor is concurrently connected to the load so as to concurrently provide the desired level of the regulated signal output to the load.

Figure 3:
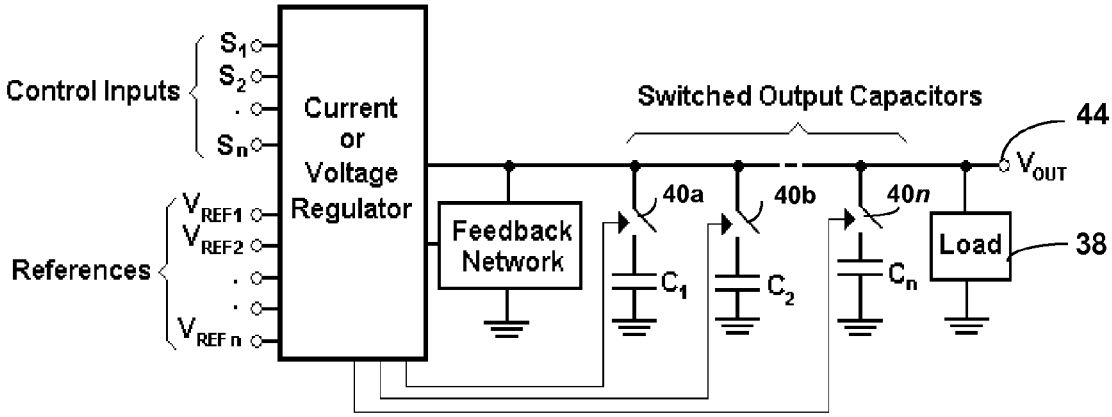
FIG. 3 is a generalized partial block and partial schematic diagram of another embodiment of a current or voltage regulator employing a plurality of bypass capacitors for use in operating in any one of a plurality of regulation states.

While the FIG. 2 embodiment is shown with a switch 40 connected between a corresponding capacitor C and system ground, the regulator will work equally as well if each switch 40 and capacitor are exchanged so that the capacitor is connected between the corresponding switch and system ground, as shown as the embodiment illustrated in FIG. 3.

Figure 4:
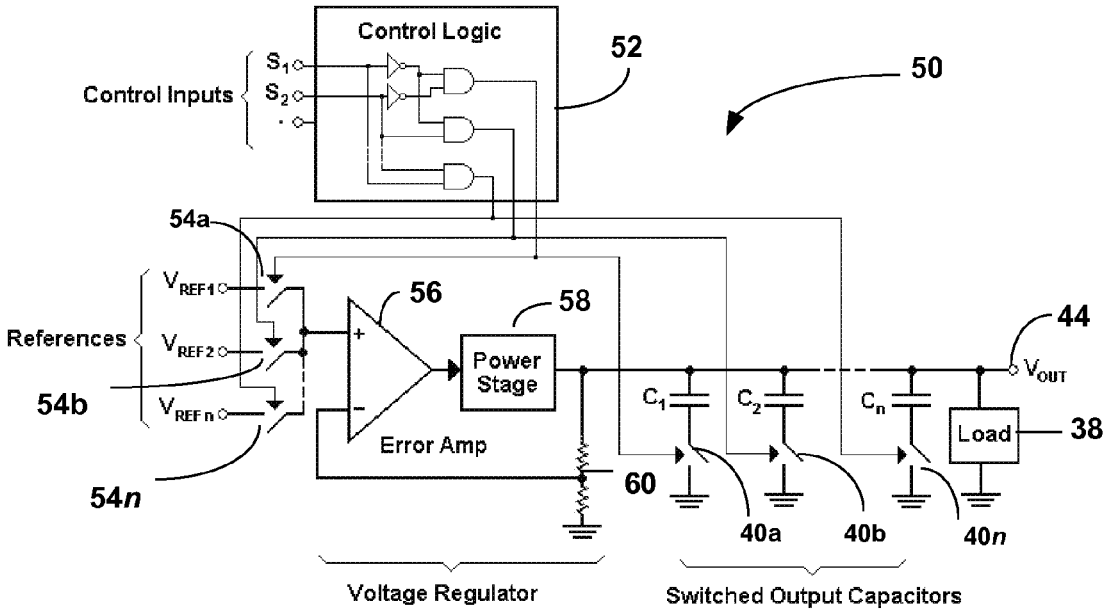
FIG. 4 is a generalized partial block and partial schematic diagram of the embodiment of FIG. 2, further showing more details of the control logic and an error amplifier.

Further details of one embodiment of the regulator are shown in FIG. 4. The regulator is shown as an exemplary voltage regulator 50. The S inputs are applied to the control logic 52, while the $V_{REF}$ inputs are connected to switches 54. Switches 54 are each controlled by the control logic 52. When each switch 54 is closed the corresponding $V_{REF}$ input is connected to the non-inverting input of the error amplifier 56. The output of the error amp 56 is applied to the power stage 58. The latter in turn is connected to the output 44, and to the voltage divider 60. The voltage divider 60 is connected to system ground, while the tap of the voltage divider is connected to the inverting input of the error amplifier 56. Control logic 52 includes logic for selectively closing a set of switches comprising a switch 54 and the corresponding switch 40 so that the desired $V_{REF}$ is connected to the non-inverting input of the error amplifier 56. When one set of switches 40 and 54 is closed, a desired value of $V_{REF}$ is connected to the input of the error amplifier, and a desired capacitor C is connected between the regulator output 44 and system ground. Precharged capacitor C will immediately set the output voltage to the precharged voltage level, while the regulator slews to the level through its normal feedback process. In this way the output is brought to the desired level much more quickly than otherwise allowed by various factors including limitations due to the current sinking or sourcing capabilities of the regulator, the impedance of the load, the size of a single output capacitor, and the bandwidth of the regulator's control loop.

Figure 5:
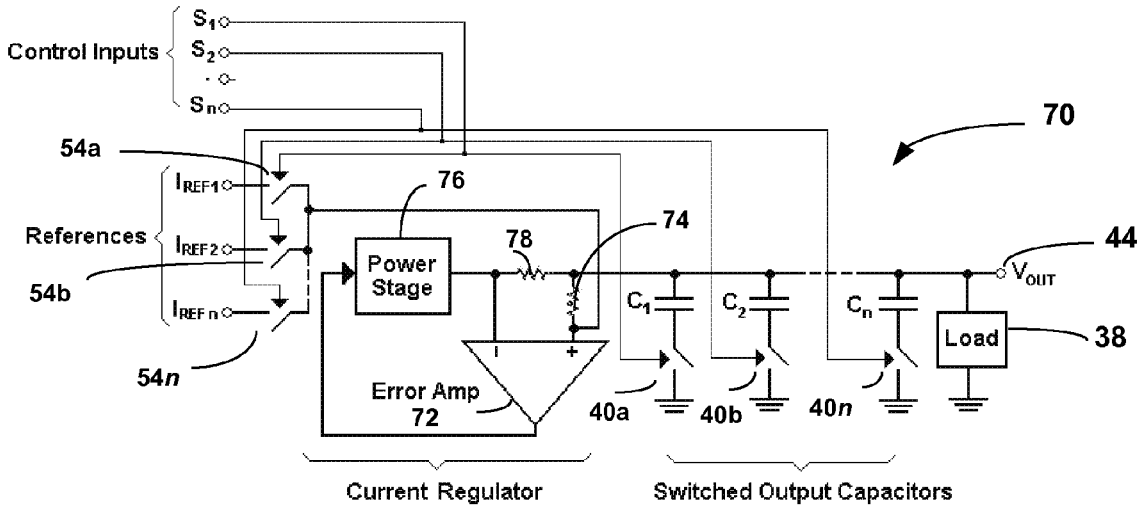
FIG. 5 is a generalized partial block and partial schematic diagram of a current regulator, further showing more details of the application of control signals for controlling the plurality of bypass capacitors.

In another embodiment, the regulator shown in FIG. 5 is an example of a current regulator. As illustrated, current regulator 70 includes the control inputs S each controlling a respective set of switches 54 and 40. In this instance, the desired reference inputs are currents $I_{REF1}$, $I_{REF2}$ . . . $I_{REFn}$. When the appropriate switch 54 is closed the corresponding $I_{REF}$ is applied to the non-inverting input of the error amplifier 72. The input of the error amplifier 72 has its non-inverting input connected through resistor 74, which in turn is connected the node forming the output 44 of the regulator. The output of the error amplifier 72 is connected to the input of the power stage 76, which in turn has its output connected to the inverting input of the amplifier 72. A resistor 78 is connected between the inverting input of error amplifier 72 and the resistor 74. In operation, each set of switches is closed to allow a corresponding $I_{REF}$ to flow into the current regulator control circuit, and charge the corresponding capacitor C at the output of the control circuit. When the switches 40 are open, the corresponding capacitors will hold the appropriate charge corresponding to the respective references currents $I_{REF}$. The output voltage across each capacitor is determined by the corresponding regulated current flowing through the load 38. When a particular regulation state is desired, the appropriate control switch S is applied to close the corresponding set of switches 54 and 40 connecting the desired $I_{REF}$ to the input of amplifier 72. As the amplifier slews to the reference value at it non-inverting input, the desired value of the output voltage is applied from the precharged capacitor C that is connected through the appropriate switch 40 to the output 44.

Figure 6:
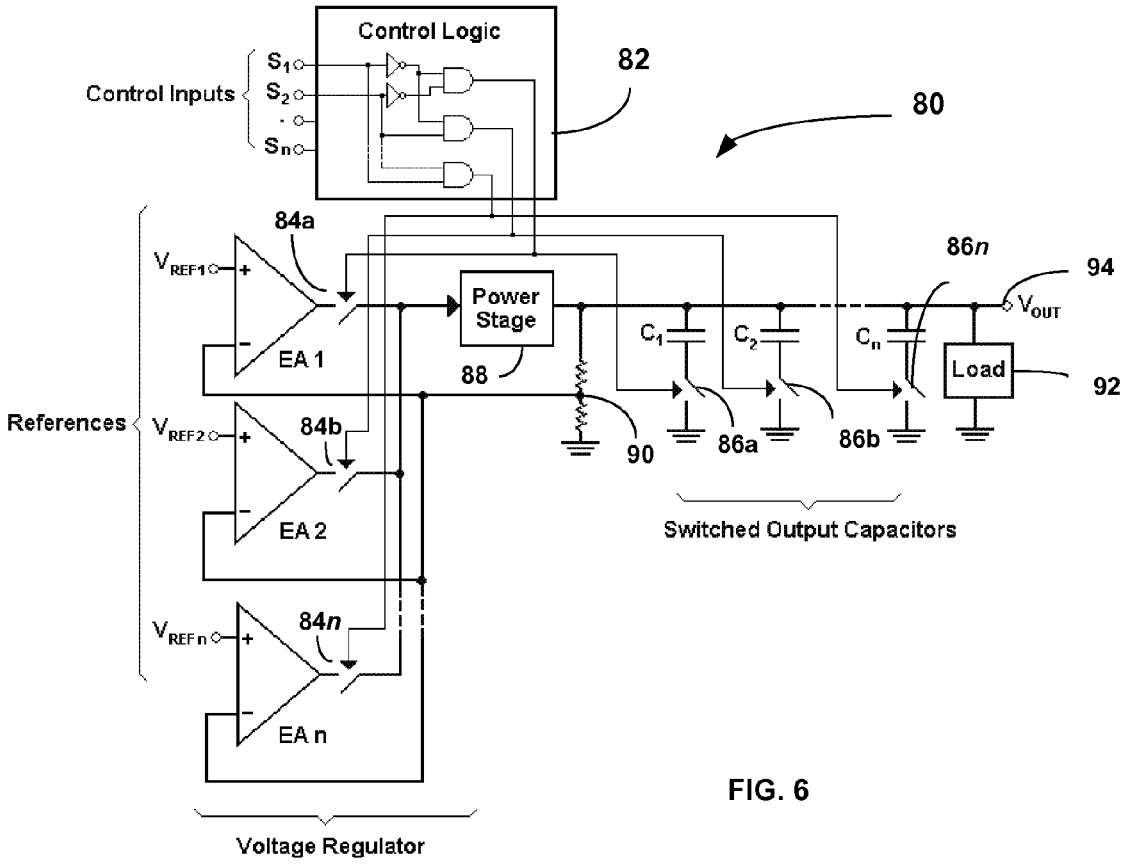
FIG. 6 is a generalized partial block and partial schematic diagram of the embodiment of FIG. 2, further showing more details of the control logic and a plurality of error amplifiers.

In yet another embodiment, the regulator shown in FIG. 6 is an example of a voltage regulator employing a plurality of error amplifiers EA. As illustrated, the regulator 80 includes the control logic 82 for controlling the operation of each set of switches 84 and 86 in response to the control inputs S. In this illustrated embodiment, an error amplifier EA is provided for each regulation state. According to this embodiment, each error amplifier EA1, EA2 . . . EAn has its input connected to receive one of the reference voltages, and a separate switch 84 for selectively connecting the output of the amplifier to the input of the power stage 88. The output of stage 88 is connected to resistor divider 90, the tap of which is connected to the inverting input of each error amplifier EA. Thus, when the regulator 80 needs to be set for a particular regulated state, the appropriate control input S will close the correct switch 84 and switch 90 corresponding to the desired regulated state. This will connect the correct error amplifier EA with the power stage 88, and the correct capacitor C to system ground, so as to provide the corresponding regulated voltage (stored on the correct capacitor) to the output 94 and load 92 while the error amplifier EA slews to its regulated output value determined as a function of the input $V_{REF}$.

Figure 7:
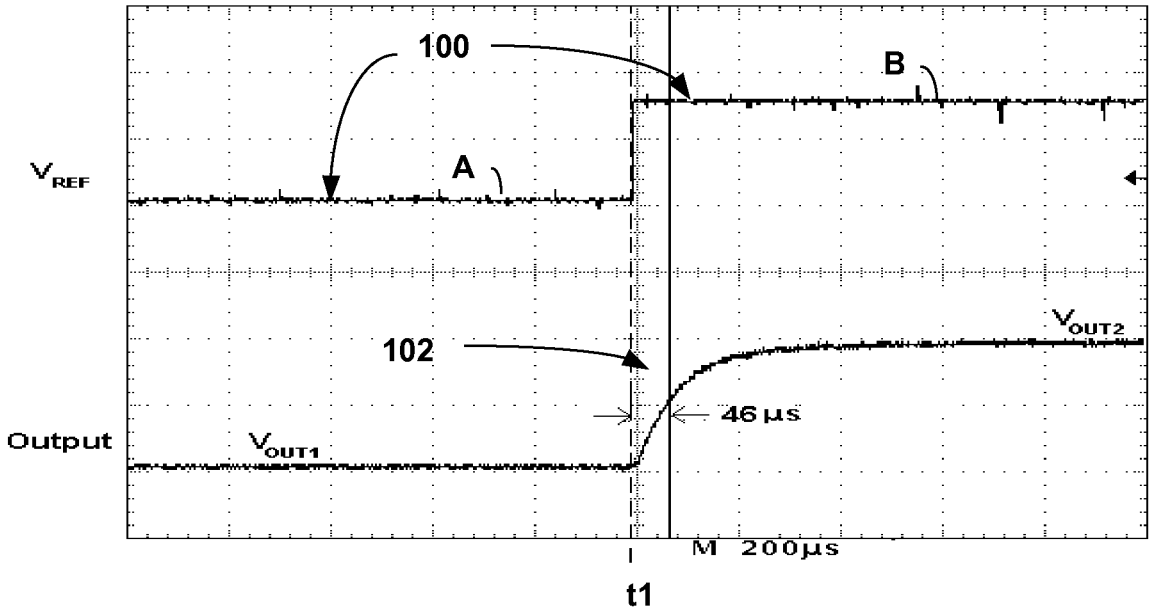
FIG. 7 is a graphical illustration of an exemplary response of a current or voltage regulator of the type shown in FIG. 1 showing the rise time of the voltage output in response to a step in the reference voltage.

The major advantage of providing the multiple capacitors, so as to store each precharged output voltage at a predetermined desired level for each regulated state, is illustrated by the comparator experimental results between a regulator employing a plurality of switched capacitors and the prior art approach. FIG. 7 illustrates the response of changing from one regulated state to another using the prior art regulator similar to that shown in FIG. 1. As shown when the reference voltage 100 is changed at time t1, so as change from level A to level B, the output of the regulator slews from level $V_{OUT1}$ to level $V_{OUT2}$. However, the output does not change as quickly as the change in the application of the reference voltage. Instead it takes time as indicated at 102 to slew from one output value to the next. As shown, while the reference voltages are switched very quickly from one reference value to the next, it takes the output voltage significant time to respond. In the example shown the reference voltage switches from one value to the next almost instantaneously, while it takes more than 200 microseconds for the output voltage to settle at its new value for the new regulated state.

FIG. 8 illustrates the response of a regulator employing a plurality of switched capacitors. As can be seen, when the control signal at level 110 for one regulated state is changed to another control signal 112 for a new desired regulated state the transition still occurs relatively quickly relative to the output response. However, in this instance the output voltage is change as illustrated at 114 almost 100 times faster than the response shown as the output response in FIG. 7 because of the value stored on the corresponding capacitor for the new regulation state is immediately applied to the output of the regulator in response to the change in control signals.

The comparative differences between the results illustrated in FIGS. 7 and 8 are more clearly show in FIG. 9, where both results are plotted on the same graph. The control and VREFs are superimposed at 120 for simplification purposes, while the output response of the regulator of the prior art type is shown at 122, and the output response of a regulator using multiple switched capacitors is shown at 124.

It should be appreciated that while the storage devices are described as capacitors, other types of storage devices can be used, such as inductors. Further, more than one capacitor can be used to establish a regulated state by switching more than one capacitor to the output when switching to a new regulated state.

An example of an application of the regulator with a plurality of switched capacitors is a control regulator that can be used to provide any one for a plurality of regulated operating states of an LED where a plurality of different regulated states are possible. For example, such an arrangement might require three regulated states including zero current, a low level current (0 to 4 A) and high current (4 to 30 A). However, it should be appreciated that the plural switched capacitor arrangement can applied to any regulation scheme where two or more states are desired with a rapid transition time between the states is required.

While there has been illustrated and described particular embodiments of the present disclosure, it will be appreciated that numerous changes and modifications will occur to those skilled in the art. Accordingly, it is intended that the appended claims cover all those changes and modifications which fall within the spirit and scope of the present disclosure.

What is claimed is:

1. A regulator constructed and arranged so as to provide any one of a plurality of desired levels of a regulated signal output to a load, each desired level being a function of a corresponding reference signal, the regulator comprising:

(1) a plurality of capacitors, each sized so as to be capable of being charged to a predetermined voltage;

(2) a plurality of switches for selectively connecting at least one of the capacitors to the load depending on and as a function of the desired level of the regulated signal output so that when the reference signal is changed, at least one select capacitor is concurrently connected to the load so as to concurrently provide the desired level of the regulated signal output to the load;

(3) a control loop having a bandwidth for maintaining the regulated signal output at the desired level;

wherein the plurality of switches selectively connect at least one select capacitor to the load as a function of the desired regulated output independently of the bandwidth of the control loop.

2. The regulator according to claim 1, wherein the voltage from each capacitor connected to the load will maintain the regulated signal output at the desired level until needed, so that the regulator is not required to slew the output voltage to the desired level when large changes in the reference voltage occur.

3. The regulator according to claim 1, wherein each capacitor is capable of being charged to a voltage corresponding to a respective one of the desired regulated signal outputs, and the plurality of switches are configured so that only one switch connects to the load at a time so as to provide the corresponding desired regulated signal output to the load.

4. The regulator according to claim 1, wherein the capacitors are sized and the plurality of switches \are configured so that more than one of the capacitors may be connected to the load for at least one of the desired levels of regulated signal outputs.

5. The regulator according to claiml, further including a plurality of inputs configured to receive a plurality of reference signals and control signals so as to control the application of the reference signals to the regulator, the switches being controlled so that at least one capacitor is connected to the load as a function of the reference signal applied to the regulator.

6. The regulator according to claim 1, wherein each capacitor and a corresponding switch are connected together in series, and in parallel with the load.

7. The regulator according to claim 6, wherein each switch is connected between the corresponding capacitor and system ground.

8. The regulator according to claim 6, wherein each capacitor is connected between the corresponding switch and system ground.

9. The regulator according to claim 1, further including a feedback network arranged so as to establish a control circuit for maintaining the output of the regulator at the desired level.

10. The regulator according to claim 9, wherein the feedback network includes at least one error amplifier.

11. The regulator according to claim 9, wherein the feedback network includes a plurality of error amplifiers, one for each desired level of regulated signal outputs.

12. The regulator according to claim 1, wherein the regulator is a current regulator.

13. The regulator according to claim 1, wherein the regulator is a voltage regulator.

14. A method of providing any one of a plurality of desired levels of a regulated signal output to a load, each desired level being a function of a corresponding reference signal, the method comprising:

(1) storing each desired level of the regulated signal output on a switchable storage device;

(2) selectively switching the correct storage device to the output when switching from one regulated state to another so as to establish the desired level of regulated signal output;

(3) maintaining the regulated signal output at the desired level using a control loop having a bandwidth; and (4) selectively connecting at least one select capacitor to the load as a function of the desired regulated output independently of the bandwidth of the control loop.

* * * * *